US008122619B2

(12) United States Patent
Embry

(10) Patent No.: US 8,122,619 B2
(45) Date of Patent: Feb. 28, 2012

(54) SNOW REMOVAL DEVICE

(75) Inventor: Richard D. Embry, Indianapolis, IN (US)

(73) Assignee: Richard D. Embry, Indianapolis, IN (US)

( * ) Notice: Subject to any disclaimer, the term of this patent is extended or adjusted under 35 U.S.C. 154(b) by 70 days.

(21) Appl. No.: 12/407,926

(22) Filed: Mar. 20, 2009

(65) Prior Publication Data

US 2009/0249658 A1 Oct. 8, 2009

Related U.S. Application Data

(60) Provisional application No. 61/042,057, filed on Apr. 3, 2008.

(51) Int. Cl.
*E01H 5/00* (2006.01)

(52) U.S. Cl. ..... 37/196; 37/244

(58) Field of Classification Search ..... 37/196, 37/246, 244, 248, 249, 250
See application file for complete search history.

(56) References Cited

U.S. PATENT DOCUMENTS

| | | | | | |
|---|---|---|---|---|---|
| 2,171,075 | A | * | 8/1939 | Blazier | 15/79.2 |
| 3,200,519 | A | * | 8/1965 | Kennedy | 37/246 |
| 3,731,407 | A | | 5/1973 | Indzeoski | 37/43 B |
| 4,190,972 | A | * | 3/1980 | Berner | 37/246 |
| 4,255,880 | A | * | 3/1981 | McMickle et al. | 37/259 |
| 4,295,285 | A | * | 10/1981 | Stevens | 37/246 |
| 4,329,792 | A | * | 5/1982 | Berner | 37/246 |
| 4,377,044 | A | | 3/1983 | Krug | 37/245 |
| 4,378,644 | A | * | 4/1983 | Tuggle et al. | 37/244 |
| 4,930,176 | A | | 6/1990 | Gelman | 15/4 |
| 5,522,162 | A | * | 6/1996 | Allison | 37/242 |
| 5,553,406 | A | * | 9/1996 | Cerny | 37/259 |
| 5,603,173 | A | * | 2/1997 | Brazell | 37/244 |
| 6,212,799 | B1 | * | 4/2001 | Gingerich et al. | 37/246 |
| 6,615,928 | B2 | * | 9/2003 | Dueitt | 172/41 |
| 6,643,958 | B1 | * | 11/2003 | Krejci | 37/223 |
| 6,948,569 | B1 | * | 9/2005 | Conaway et al. | 172/371 |
| D519,127 | S | * | 4/2006 | Shaffer et al. | D15/10 |
| D524,824 | S | * | 7/2006 | Shaffer et al. | D15/10 |
| 7,257,909 | B2 | * | 8/2007 | Shaffer et al. | 37/242 |
| 7,314,096 | B2 | * | 1/2008 | Shaffer et al. | 172/372 |
| 2003/0180085 | A1 | * | 9/2003 | Hughes | 401/289 |
| 2006/0070265 | A1 | * | 4/2006 | Cohen | 37/246 |
| 2008/0250570 | A1 | * | 10/2008 | Dayton et al. | 7/170 |

OTHER PUBLICATIONS

Printout from www.usdieselengines.com/shop, Dec. 26, 2007; 3 pgs.
Printout from www.snowjoe.com/products, Dec. 26, 2007; 2 pgs.
Printout from www.consumersearch.com/www/lawn_and_garden/snow-blowers/review.html, Dec. 26, 2007; 7 pgs.
Printout from www.shop.consumersearch.com/toro_power_shovel, link_id, Dec. 26, 2007; 2 pgs.
Printout from www.shop.consumersearch.com/Yard_Machines_Snow_Fox, Dec. 26, 2007; 1 pg.
Printout from www.nolansupply com/superpower.asp., Dec. 28, 2007; 6 pgs.

* cited by examiner

*Primary Examiner* — Robert Pezzuto
*Assistant Examiner* — Jamie L McGowan
(74) *Attorney, Agent, or Firm* — Woodard Emhardt Moriarty McNett & Henry LLP

(57) ABSTRACT

A snow removal device includes a power source or is connectable to a power source for powering a drive motor that is connected to a snow removal mechanism. The overall size and construction is designed to be lightweight and portable. In this way, considering the smaller size of the snow removal mechanism and its maneuverability, it is suitable to assist in removing snow from around the tires of a vehicle that is stuck in the snow, as one example of a suitable use.

9 Claims, 12 Drawing Sheets

SNOW REMOVAL DEVICE

CROSS REFERENCES TO RELATED APPLICATIONS

The present application claims the benefit of U.S. Provisional Application No. 61/042,057, filed Apr. 3, 2008, which is hereby incorporated by reference.

BACKGROUND OF THE INVENTION

The disclosed embodiments relate to the construction and use of devices for the removal of snow from a specific site. As with conventional snow removal devices such as snow blowers and snow throwers, removal of snow from a specific site typically means transferring the snow from that site to a remote site. These conventional devices may be gasoline powered or electric powered and are normally constructed for snow removal from a generally planar surface, such as a walkway, a paved driveway, a patio, a parking lot, or a roadway. The snow removal mechanism within the device can assume a variety of forms such as a rotatable blade or series or blades, a paddle wheel with a plurality of vanes, an auger, a series of spokes, and an array of brush bristles.

Another common or typical characteristic of prior art snow removal devices is their substantial weight as well as substantial size and the need to be pushed or driven in some manner. This is why some type of traction structure or drive train is often included and/or at least two or four wheels are provided to facilitate travel of the snow removal device. Although a few designs have been offered that are of reduced weight as a way to make the device more suitable for a wider range of users, the basic principle of use and the use on a generally planar surface remain substantially the same. This basic principle of use is to stand behind the device, grip a pushing handle with two hands, and guide the device across a generally planar surface, typically by pushing.

One problem that can confront individuals living in northern locations that frequently experience snowfall levels of several inches, or at least those traveling in such northern locations, is getting a vehicle stuck in deep snow. While this problem might be encountered if the vehicle slides off the road into a deep snow bank, this problem might also occur in a driveway or when driving through deep snow that might have been left from municipal or private snowplows.

The deep snow surrounding one or more of the vehicle's wheels causing the vehicle to become stuck in the snow needs to be shoveled or scooped away in hopes of freeing the vehicle. The vehicle wheel or wheels that are unable to get traction on a firm surface are unable to do so because of the layer of snow serving as a buffer between the wheel and traction surface, typically a road, the ground, a driveway, etc. The most common method of trying to free a vehicle that is stuck in the snow is to grab a shovel (assuming you have one) and try to dig out. This obviously requires that the driver of the vehicle remembered to include a shovel or somehow locates one. Since the mechanical principles of a shovel and its center of gravity when being used to remove snow cause it to be heavy and awkward to use, this particular method of snow removal has several drawbacks. Another concern is the ability of the user to get close enough to the wheel of the vehicle if it is off the road and stuck in deep snow. Since shovel handles are relatively short in consideration of the load at the distal end and the moment arm, it may not be possible for a vehicle driver to actually dig out without getting into the deep snow so as to get close enough to the wheel or wheels that are struck to try and remove some of the snow. Considering the weight of the shovel and the load of snow, the user can reach a point of exhaustion very quickly. Heart patients are advised to not shovel snow, further complicating the problems for such individuals.

Obviously, none of the conventional snow blowers or snow throwers is suitable for snow removal of the deep snow around a vehicle wheel. There has not been any attention given to trying to facilitate the removal of snow from around a vehicle wheel or tire by using some of the snow removal principles and mechanisms that are common to more conventional snow removal devices. However, if a small, portable device could be constructed that would incorporate snow removal principles of much larger systems into a more maneuverable device, it could replace the shovel, or similar manual implement, as a way to remove the snow from around the wheels (tires) of a stuck vehicle.

The embodiments disclosed herein provide such a device. The construction options and opportunity to include various snow removal mechanisms contribute to the flexibility, versatility, and ease of use of the disclosed devices. All of the device components and accessories are able to be packaged into a convenient carrying case as part of the overall principle of portability. This allows the carrying case to be kept in a vehicle such that the snow removal device is always available in the event the vehicle gets stuck in the snow.

BRIEF SUMMARY

A snow removal device includes a power source or is connectable to a power source for powering a drive motor that is connected to a snow removal mechanism. The overall size and construction is designed to be lightweight and portable. In this way, considering the smaller size of the snow removal mechanism and its maneuverability, it is suitable to assist in removing snow from around the tires of a vehicle that is stuck in the snow, as one example of a suitable use.

DETAILED DESCRIPTION

Figure 1:
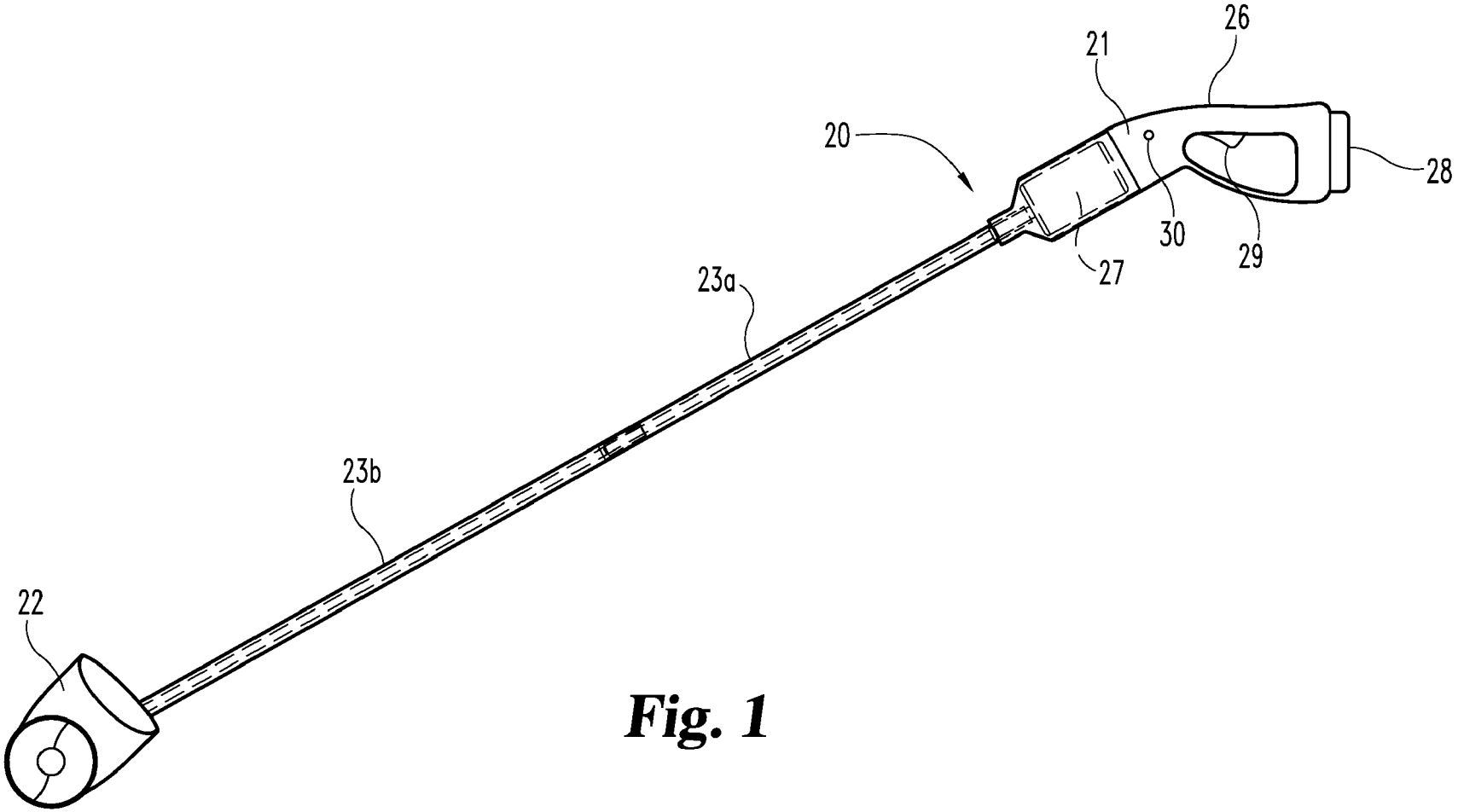
FIG. 1 is a perspective view of a snow removal device according to the present disclosure.
Figure 2:
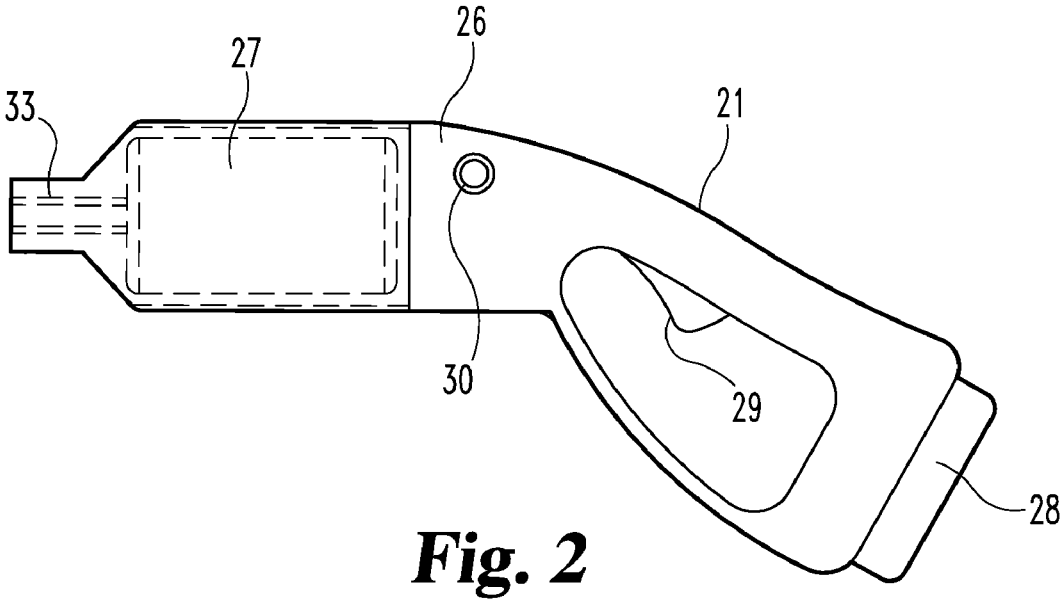
FIG. 2 is a front elevational view of a handle/motor subassembly comprising one portion of the FIG. 1 snow removal device.
Figure 3:
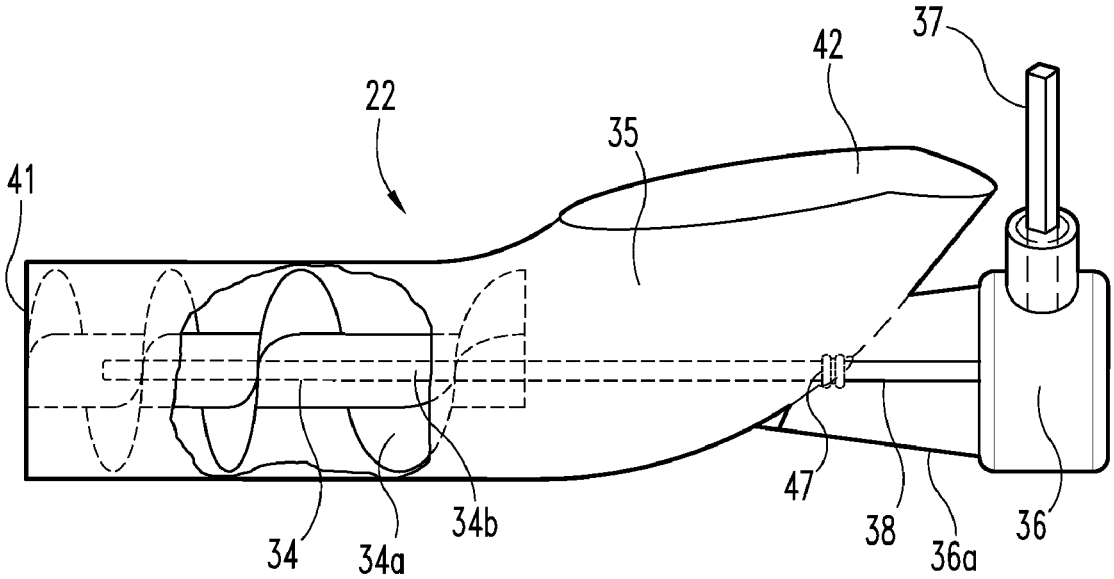
FIG. 3 is a perspective view of a snow removal mechanism comprising one portion of the FIG. 1 snow removal device.
Figure 4A:
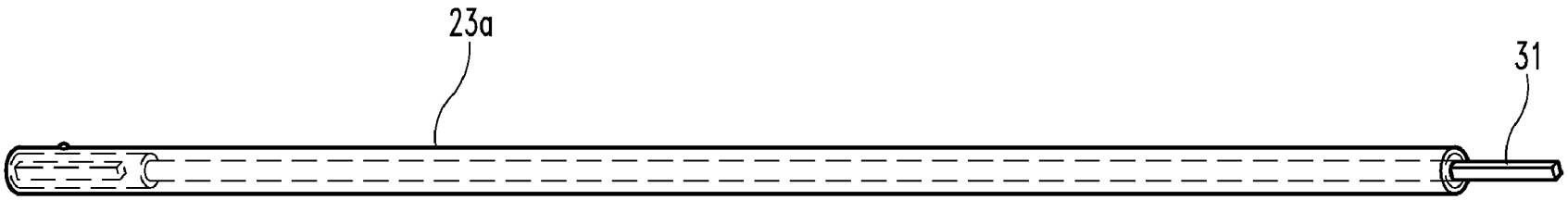
FIG. 4A is a perspective view of a shaft extension section comprising one portion of the FIG. 1 snow removal device.
Figure 4B:
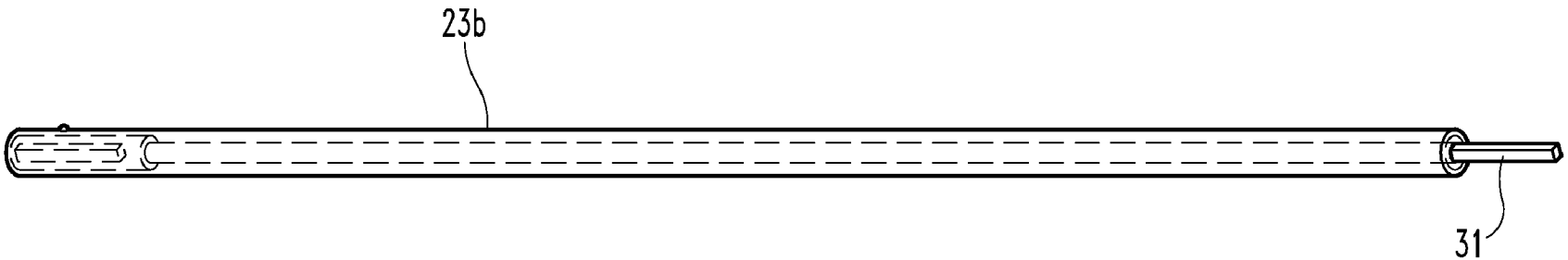
FIG. 4B is a perspective view of a second shaft extension section providing an optional component to the FIG. 1 snow removal device.

For the purposes of promoting an understanding of the disclosure, reference will now be made to the embodiments illustrated in the drawings and specific language will be used to describe the same. It will nevertheless be understood that no limitation of the scope of the disclosure is thereby intended, such alterations and further modifications in the illustrated device and its use, and such further applications of the principles of the disclosure as illustrated therein being contemplated as would normally occur to one skilled in the art to which the disclosure relates.

Referring to FIGS. 1-4B, there is illustrated a portable snow removal device 20 in fully assembled condition, all as according to one embodiment of the present disclosure. As illustrated and disclosed in FIGS. 2, 3, 4A and 4B, the primary component parts can be disassembled for added convenience. Device 20 includes, as its component parts, a handle/motor subassembly 21, a snow removal mechanism 22, and shaft extension sections 23*a* and 23*b*. In this regard, it should be understood that shaft extension section 23*b* would not have to be used if the distance from the user to the site of snow removal was fairly short. While the same could likely be said for shaft extension section 23*a*, it is anticipated that virtually all situations for snow removal using device 20 would involve the use of subassembly 21 connected to shaft extension section 23*a* that is in turn connected to snow removal mechanism 22.

Handle/motor subassembly 21 is constructed and arranged for manual gripping and includes a molded plastic housing 26 that houses a reversible drive motor 27 (12-18 VDC) and a removable, rechargeable battery 28. The motor 27 is a reversible, variable speed motor and trigger 29 functions as the ON/OFF control as well as the speed control. Switch 30 controls the direction of motor shaft rotation.

The hollow output shaft 33 of the motor is constructed and arranged for receipt of one shaft extension section 23*a*. A square drive is contemplated with a ball detent to lock this section 23*a* into the hollow shaft 33 of motor 27. A rotatable shaft 31 is bearingly mounted inside each section. The motor shaft 33 and section shaft 31 are compatibly shaped to securely connect together such that the rotation of shaft 33 accurately translates into the rotation of section shaft 31 without any noticeable slippage. A square or D-form on the male end and a matching socket shape on the female end is one way to configure the shaft ends for connection to each other. A keyway and key is another option and either shaft can be configured with either form, so long as one shaft includes the male form and the connecting shaft includes the female form.

Figure 8:
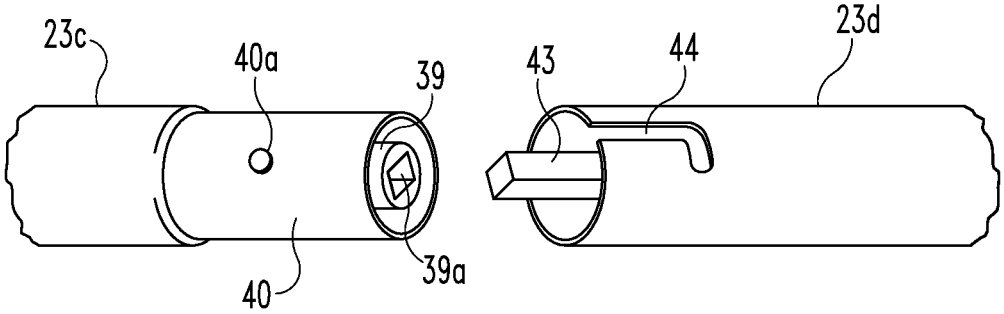
FIG. 8 is a partial, perspective view of one connection arrangement for shaft extension sections according to the present disclosure.

If a second shaft extension section 23*b* is used, it connects end-to-end with the first shaft section 23*a* such that the section shaft 31 of the second section 23*b* rotates in unison with the rotating motor output shaft 33. The manner of connection between extension sections is essentially the same as the manner of connection between the motor shaft 33 and the section shaft 31 of extension section 23*a*. Ideally, each extension section 23*a* and 23*b* is constructed the same with a male form connection at one end and a female form connection at the opposite end. Other connection options and arrangements are contemplated such that the motor shaft rotation is transferred to the snow removal mechanism 22. For example, in FIG. 8, there is illustrated a connection concept between a first shaft section 23*c* and a second shaft section 23*d*. The interior, bearingly-supported drive shaft 39 of section 23*c* has a square socket 39*a*. The outer sleeve 40 includes a pin 40*a* for slot interfit with section 23*d*. The interior, bearingly-supported driveshaft of section 23*d* has a square drive 43 for a close insertion fit into socket 39*a*. As the square drive and square socket are mated, pin 40*a* slides into slot 44. At the base of slot 44, there is a right angle turn to securely seat the pin 40*a* into the closed end of slot 44 as sections 23*c* and 23*d* are securely joined together.

An alternative to this connection technique is to replace the pin 40*a* with a spring-biased ball detent. With this change, the slot 44 is then replaced with a circular opening located where the corner bend of the slot is now located.

In one embodiment of the snow removal mechanism 22, the mechanism includes an auger 34 within a shroud 35 with a gear box 36 at one end. The gear box 36 includes an input shaft 37 for connection to an extension section 23*a* or 23*b* and an output shaft 38 for connection to or as a part of the auger 34. In the illustrated and preferred embodiment, the auger shaft 34*b* and the output shaft 38 are securely connected together by flexible coupling 47. The right angle between shaft 37 and shaft 38 is achieved by the internal gearing within gear box 36, preferably a bevel gear set (not illustrated). Extension 36*a* snaps into shroud 35 for added support and to permit one mechanism, such as auger 34, to be replaced with another style. The plastic construction of extension 36*a* and of shroud 35 provides adequate flexibility so that a tab-in-slot connection is manually releasable. The overall strength and support are not compromised while still enabling one mechanism to be replaced with another.

The shroud 35 can assume a variety of structural forms relative to the opening or openings providing access to the auger 34. The illustrated shroud 35 includes a first opening 41 for the entry or introduction of snow into the turning auger blade 34*a* and a second opening 42 or outlet for the discharge of snow. With a proper auger speed and with a proper auger blade shape or contour, it is possible to gather in snow adjacent the location of opening 41 and then expel the snow with a modest throwing velocity out through opening 42. The operation of device 20 moves snow from one location site to a remote side depending on the handling and manipulation of the mechanism 22 by the user. Wherever the snow is located that needs to be removed, the user of device 20 directs the mechanism 22 portion or head to that snow location by grasping handle 21 with one hand and, for leverage and balance, the user grabs a portion of extension section 23*a* with the other hand. This allows the mechanism 22 to be moved directly into the snow such that the snow to be removed is captured in end opening 41. In this way, the auger blade can operate on that snow and move it from one site to another. In this regard, mechanism 22 is constructed and arranged to be lighter in weight and smaller in size than a conventional push-type snow blower or snow thrower. This allows mechanism 22 to be more maneuverable and can be easily manipulated and moved into locations that might not otherwise be accessible to a conventional push-type snow blower or snow thrower. Representative of such locations are the areas around the tires/wheels of a motor vehicle that is stuck in snow.

It is also to be understood that the size, shape, and location of the first opening 41 in shroud 35 can be changed so long as routine manipulation of the snow removal mechanism 22 allows the inlet opening 41 in the shroud 35 to be positioned at the location of the snow that is to be moved from one site to a remote site. As for options and alternatives in the construction and arrangement of the snow removal mechanism 22, virtually any transport mechanism is a suitable option so long as it is capable of moving snow from one location to a remote (distant) location. While an auger is one option, the auger can be replaced by a paddle wheel with flat blades or vanes in one form or with scoop-shaped blades, curved blades, or curved vanes in another form, or by a disc-shaped brush with stiff bristles radiating like spokes, as some of the examples. Exchange of one mechanism 22 for another simply involves loosening of flexible coupling (access through opening 42) and unsnapping extension 36*a* from shroud 35.

Figure 5:
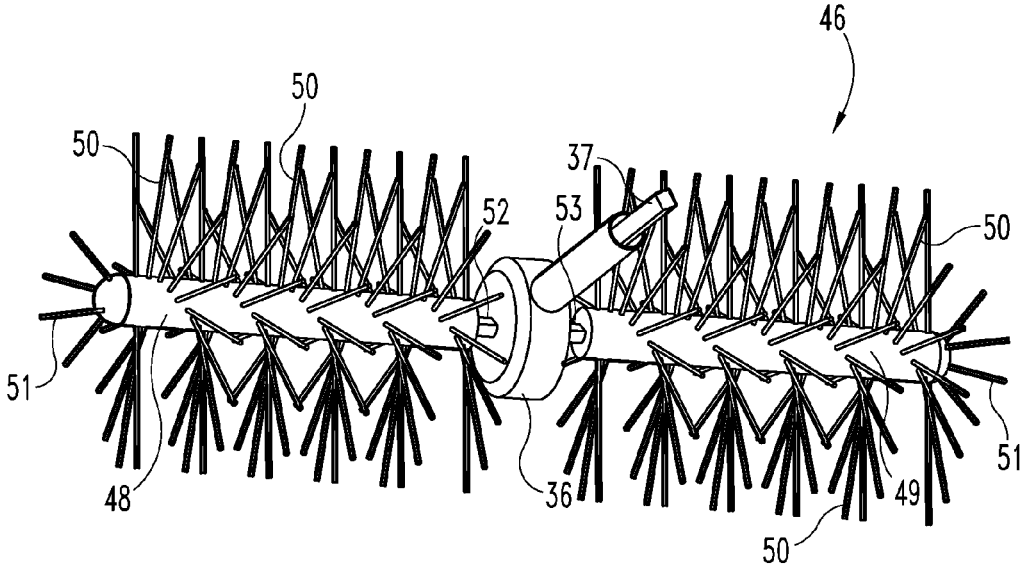
FIG. 5 is perspective view of a removable, rotatable brush mechanism suitable for use as a replacement for the FIG. 3 snow removal mechanism.
Figure 15:
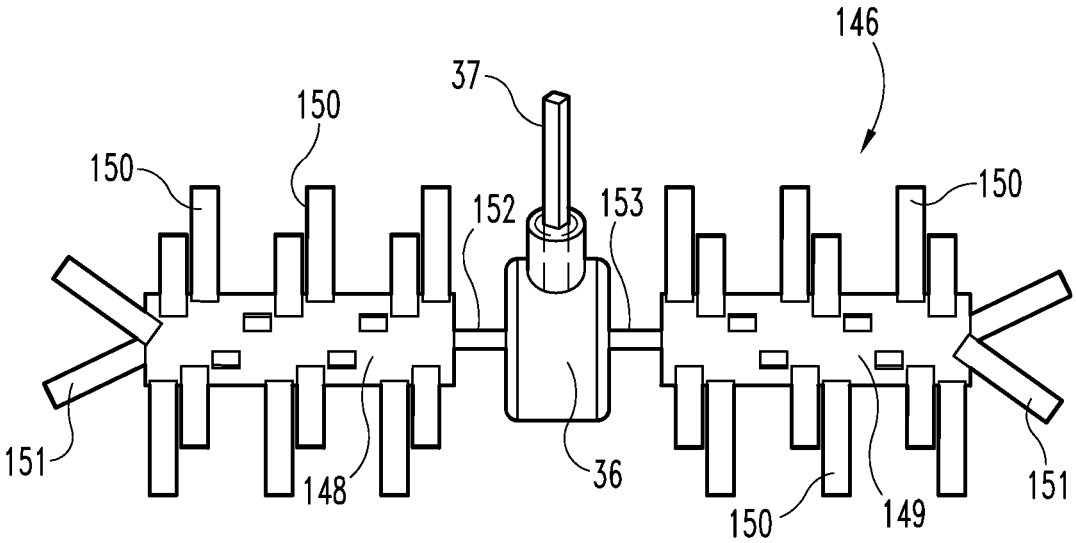
FIG. 15 is a perspective view of a removable, rotatable blade mechanism suitable for use as a replacement snow removal mechanism for the FIG. 1 snow removal device.

Referring now to FIG. 5, another option for the snow removal mechanism 22, in lieu of an auger 34, is illustrated in the form of a removable, rotatable brush 46, arranged in two sections 48 and 49 that are symmetrically arranged and spaced on opposite sides of gear box 36. Each section 48 and 49 includes radiating bristles 50 and end-extending bristles 51. The gear box input shaft 37 connects to section 23*a* or 23*b* in the manner that has been illustrated and described. Each brush section 48 and 49 includes a driveshaft 52 and 53, respectively. Each driveshaft is connected to gear box 36 at a right angle relative to input shaft 37. A similar "brush" type mechanism is illustrated in FIG. 15. The FIG. 15 structure replaces the stiff bristles of brush 46 with heavy nylon blades that are more suited to break up "frozen" and icy snow.

Figure 6:
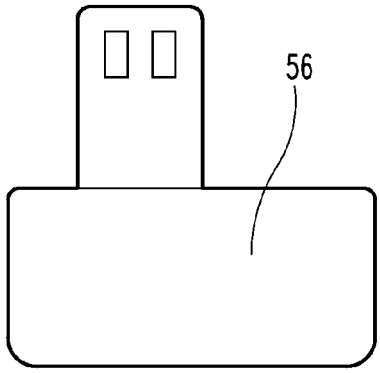
FIG. 6 is a front elevational view of a replacement battery for use in the FIG. 2 handle/motor subassembly.
Figure 7:
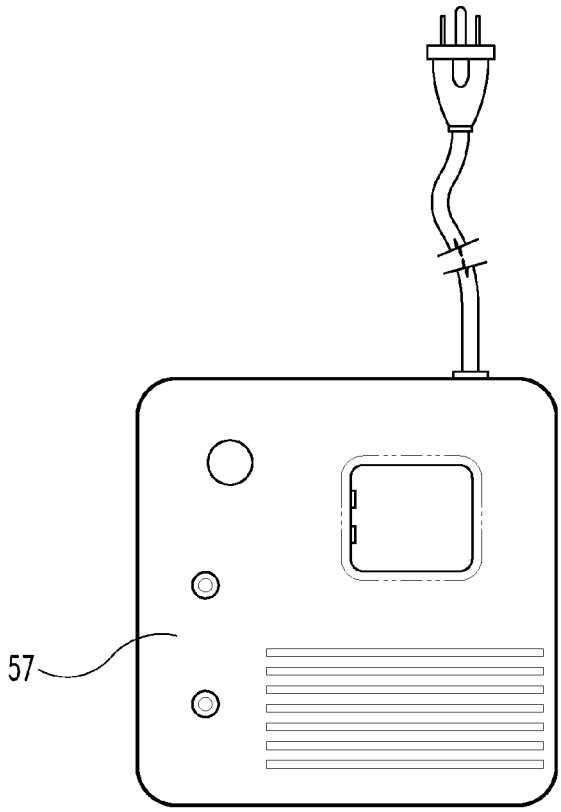
FIG. 7 is a front elevational view of a DC battery charger suitable for use in recharging the battery of the FIG. 2 handle/motor subassembly and the FIG. 6 replacement battery.

Referring to FIG. 6, replacement battery 56, the same as battery 28, is illustrated. Battery 28 that is installed into the handle/motor subassembly 21 is a removable, rechargeable battery that provides wireless power to drive motor 27. A DC battery charger 57 is illustrated in FIG. 7.

Figure 9:
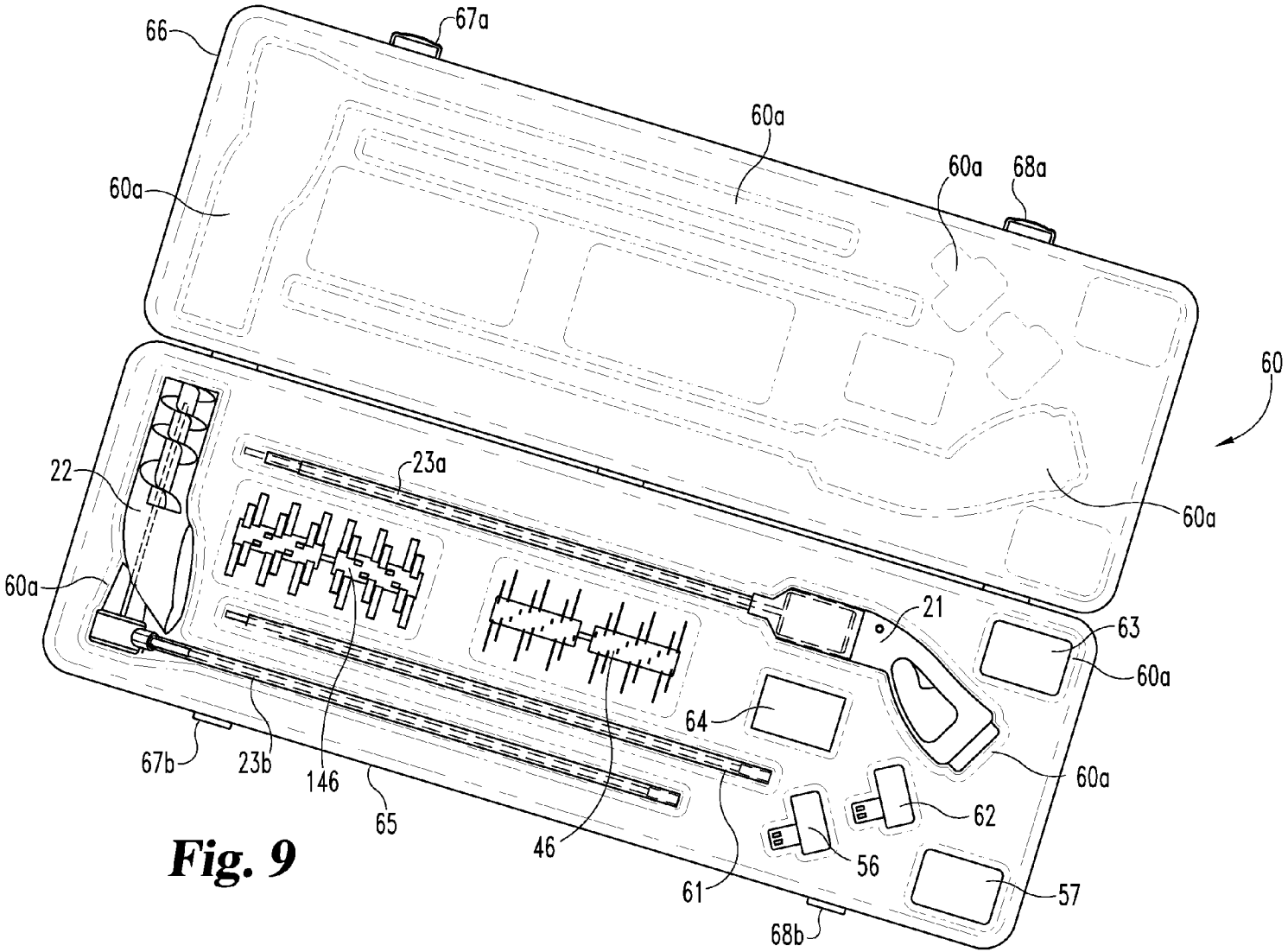
FIG. 9 is a top plan view of a carrying case including various component parts and accessories, as illustrated in FIGS. 1-7.

Referring to FIG. 9, there is illustrated a storage and carrying case 60 for snow removal device 20. Included as a part of the accessories that are received within case 60, in addition to what is illustrated in FIGS. 1-7, are an "extra" (i.e., a third) shaft extension section 61, another replacement battery 62, an AC charger 63, and DC power cord 64.

Case 60 is a molded plastic case with formed, recessed compartments 60*a* that are shaped to correspond to the shape of the component parts and spare parts as illustrated. These component parts and spare parts are generally referred to herein as "accessories". Although a generic reference of 60*a* is being used for each of these recessed compartments, it will be understood that the compartments have different shapes so as to correspond to the shape of the article received therein. The base or tray 65 is hinged to covering lid 66 and the two-part latching clasps include portions 67*a* and 67*b* and complementing portions 68*a* and 68*b*. These various clasp portions and complementing portions are positioned along the abutting edges of tray 65 and lid 66, as illustrated. In the preferred embodiment, each compartment 60*a* in tray 65 has a depth that is at least one-half the height or thickness of the corresponding component or spare part that fits into that particular recessed compartment. Each compartment 60*a* in the lid 66 has a corresponding depth of at least one-half of the height of the corresponding component or spare part. In this manner, when the lid is closed onto the tray, the various components and spare parts are encased for protection and stability while being transported.

Figure 10:
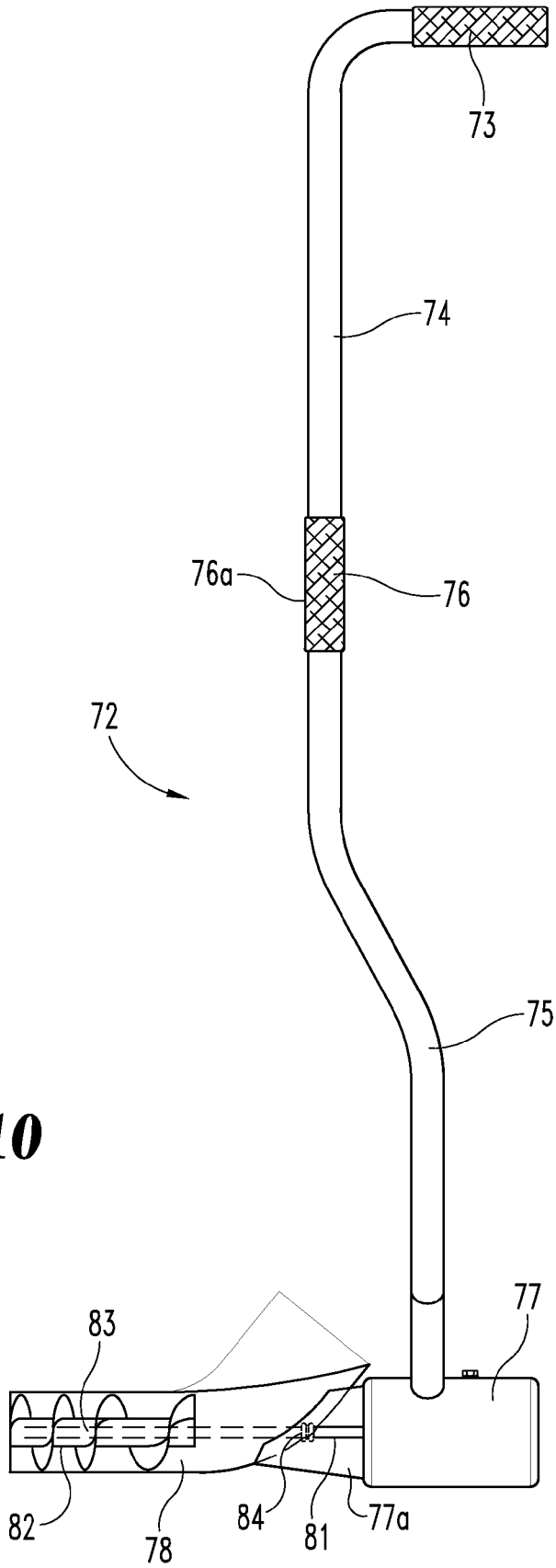
FIG. 10 is a front elevational view of an alternative embodiment of a portable snow removal device according to the present disclosure.
Figure 10A:
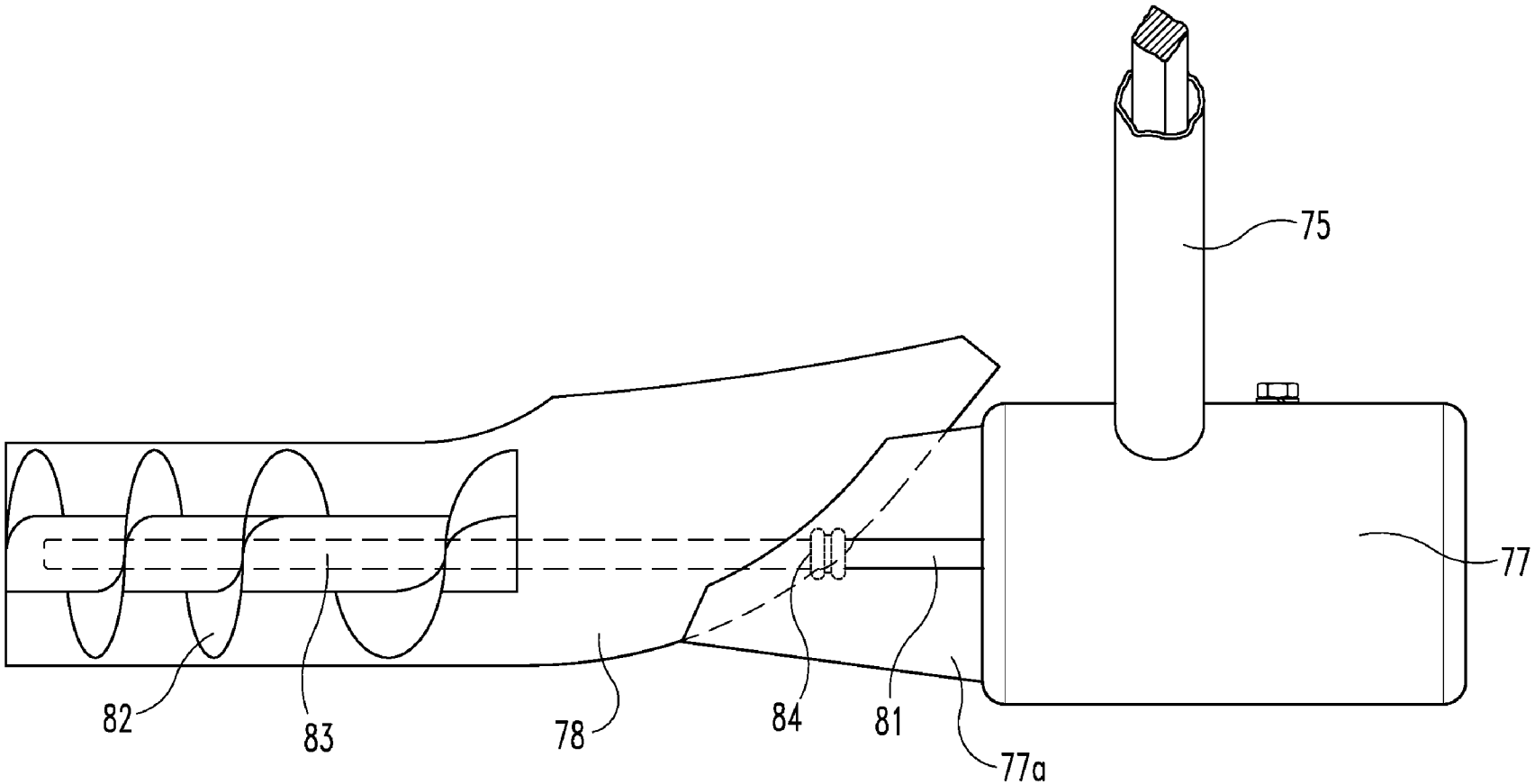
FIG. 10A is an enlarged view of the snow removal mechanism illustrated in the FIG. 10 snow removal device.

Referring now to FIGS. 10 and 10A, another embodiment is illustrated. Snow removal device 72 includes a handle grip 73, two handle sections 74 and 75, section connection 76, drive unit 77, and a detachable snow removal mechanism 78. In the preferred embodiment, mechanism 78 is substantially the same in all respects as mechanism 22. The handle grip 73 is formed as part of section 74. Section 75 is assembled into drive unit 77 at one end. The opposite end of section 75 is securely jointed with section 74 by means of section connection 76. Connection 76 includes an outer covering 76*a* that is used to cover the section-to-section joint and thereby keep out debris. The covering 76*a* also provides a gripping surface for the other hand of the user. The drive unit 77 includes the power source, preferably a rechargeable drive motor, with a rotating output shaft 81. The snow removal mechanism 78 is connectable to and detachable from the drive unit 77 with a snap-fit onto extension 77*a*, as previously described relative to extension 36*a* and shroud 35. The interior auger 82 includes a center shaft 83 that is constructed and arranged for direct connection to output shaft 81 by way of flexible coupling 84.

Figure 11:
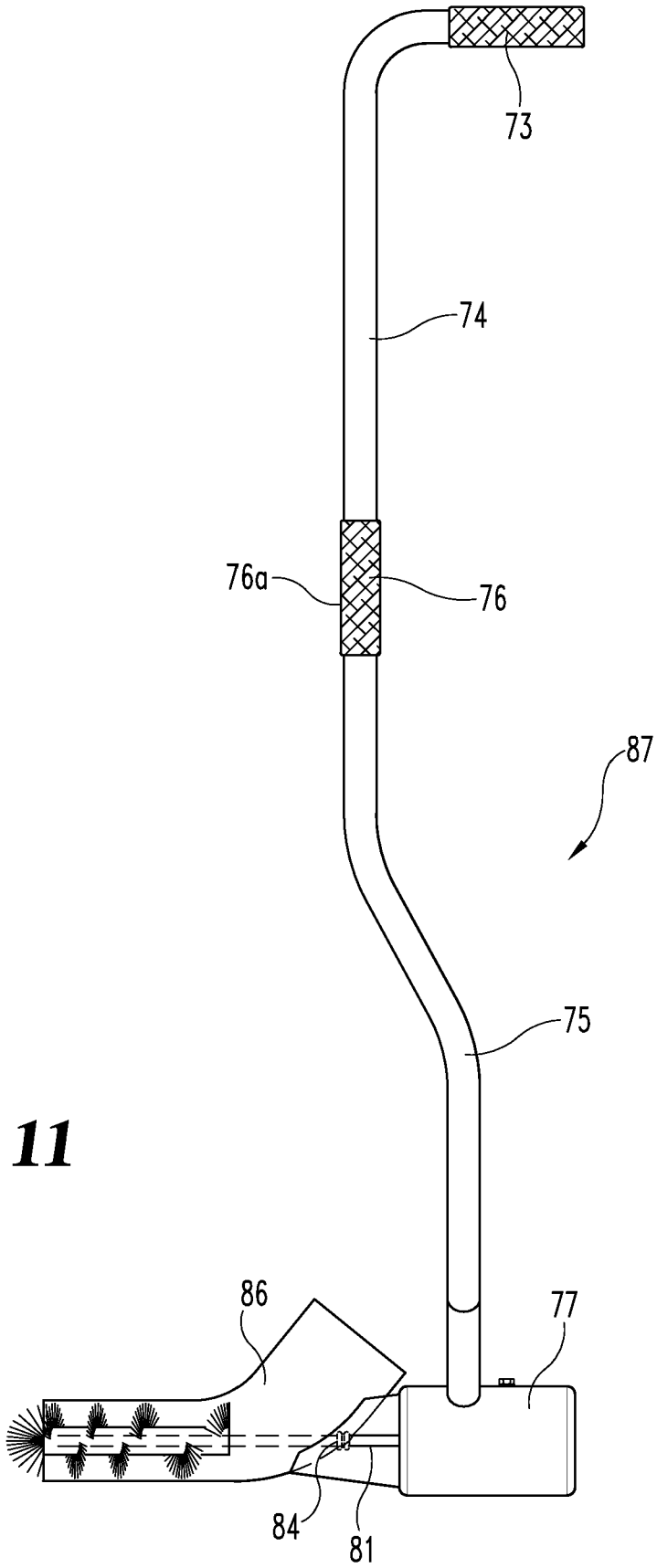
FIG. 11 is a front elevational view of an alternative embodiment of a portable snow removal device according to the present disclosure.

The detachable construction of mechanism 78 allows the auger design to be replaced with some other style or snow removal mechanism such as the removable, rotating brush 46 (see FIG. 5) or the spiral brush mechanism 86 of snow removal device 87, as illustrated in FIG. 11. Device 87 is constructed and arranged the same as device 72 with the exception that the auger blade design is replaced with a spiral brush design. Accordingly, the same reference numbers are used for the same component parts between these two embodiments.

Figure 12:
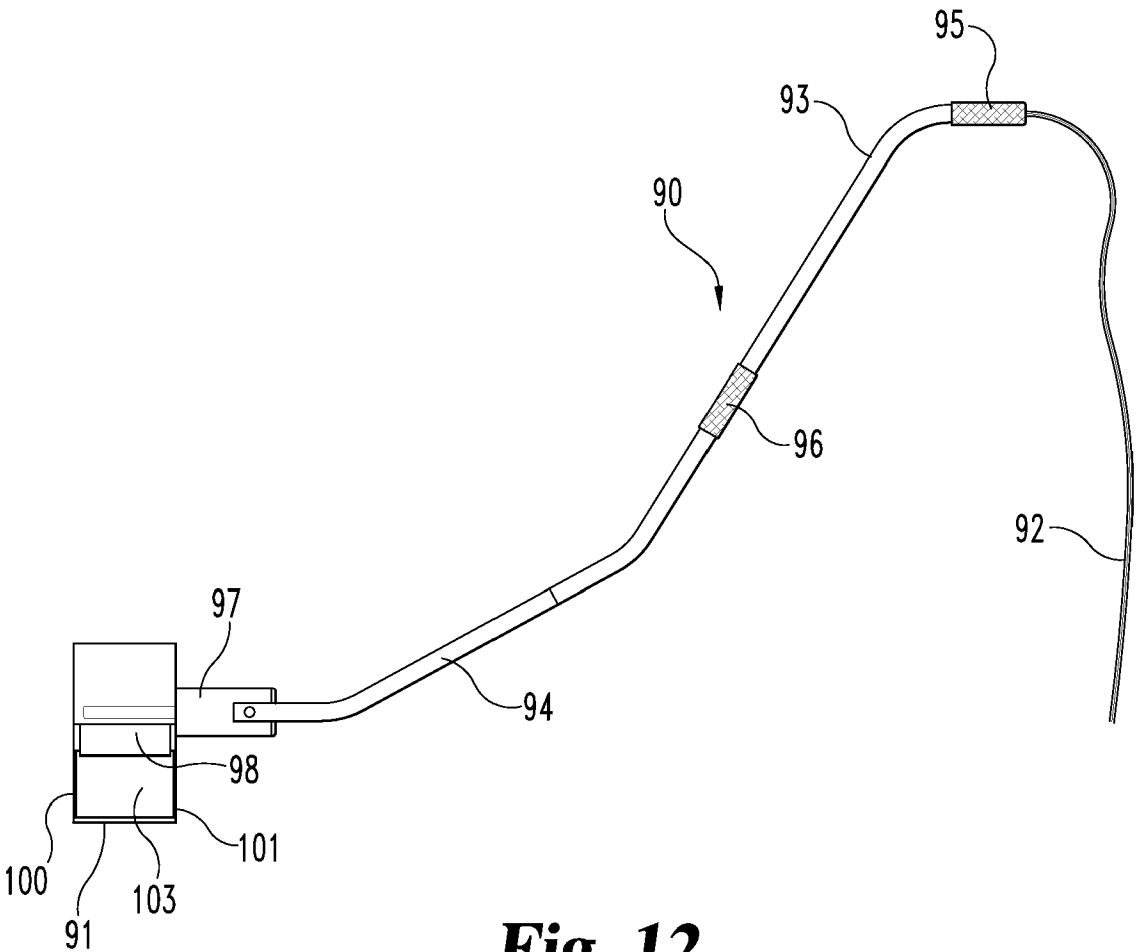
FIG. 12 is a front elevational view of an alternative embodiment of a portable snow removal device according to the present disclosure.
Figure 12A:
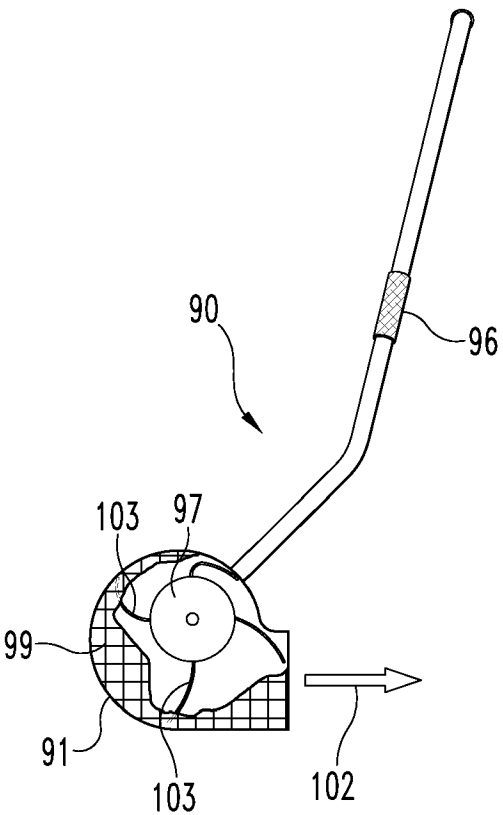
FIG. 12A is a fragmentary, side elevational view of the FIG. 12 snow removal device.

Referring to FIGS. 12 and 12A, a still further embodiment is illustrated. There are principally two differences represented by snow removal device 90 that are not found in the specifics illustrated for the earlier embodiments. In the earlier embodiments, the preferred construction was to use a rechargeable battery or rechargeable drive motor. Device 90 uses a direct power cord connection for 12 VDC from the vehicle cigarette lighter socket or alternatively from any trailer wiring that would be accessible.

Device 90 includes, as a second primary difference from the earlier embodiments, a multiple vane paddle wheel construction as part of the snow removal mechanism 91. Other components and portions of device 90 include the power cord 92, first handle section 93, second handle section 94, upper grip 95, lower grip 96, drive motor 97, paddle wheel 98, and shroud 99. The shroud includes two spaced-apart panels 100 and 101 such that the interior space is generally open. This allows the snow to be propelled outwardly in the direction of arrow 102 due to the rapidly rotating paddle wheel 98, as driven by the drive motor 97.

The power cord 92 is run through the two hollow handle sections 93 and 94 that are securely connected together and then the combination is inserted into and secured to the drive motor 97. A control (ON/OFF) switch (not illustrated) in the vicinity of grip 95 allows the ON/OFF status of the drive motor to be controlled by the user. A variable speed motor can be used. The output shaft of the drive motor is coupled to the paddle wheel shaft that is bearingly mounted and supported for high speed rotation. The vanes 103 of the paddle wheel are selected to maximize the amount of snow that can be picked up and propelled with sufficient velocity to get it clear of the site where the snow is being removed.

Figures 13, 13A:
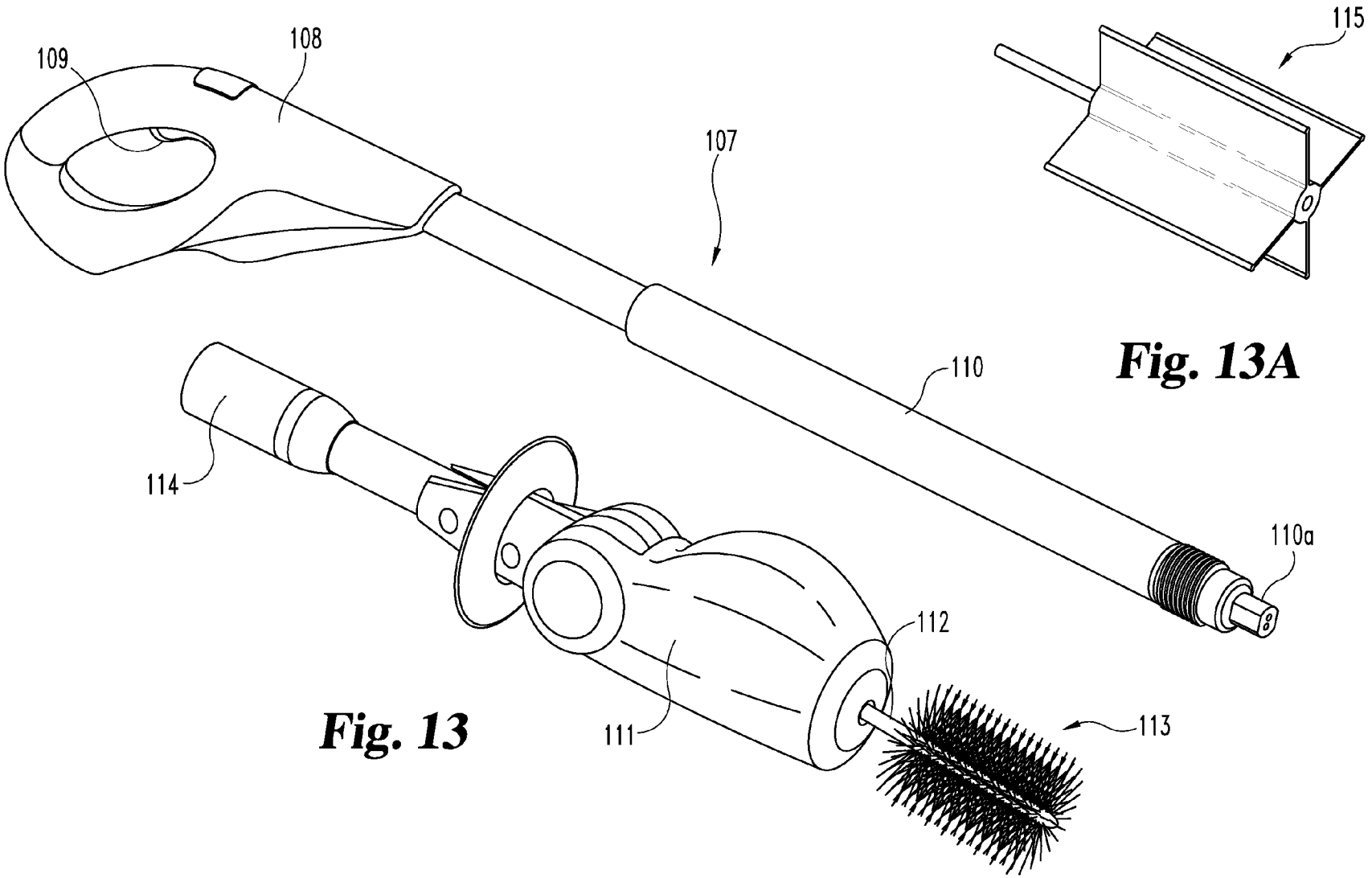
FIG. 13 is an exploded, perspective view of an alternative embodiment of a portable snow removal device according to the present disclosure.
FIG. 13A is a perspective view of a paddle wheel with vanes providing an alternative snow removal mechanism to the brush mechanism of the FIG. 13 snow removal device.

Referring to FIGS. 13 and 13A, another embodiment is illustrated. Device 107 includes a handle grip 108 and a control trigger 109 for ON/OFF operation. Shaft section 110 is joined with the handle grip 108. The snow removal mechanism 111 is configured with a rotating shaft 112 and a series of brush bristles 113. End 110*a* of section 110 connects into socket 114 of mechanism 111. Device 107 is a rechargeable unit and the preferred location for the rechargeable power supply is in the handle grip 108. In this way, the entirety of mechanism 111 can be made interchangeable for different configurations of the snow removal mechanism. Another option is to allow only the brush bristle portion 113 to be removable so as to be replaced with a different style of rotating structure, such as the paddle wheel 115 illustrated in FIG. 13A.

Figure 14:
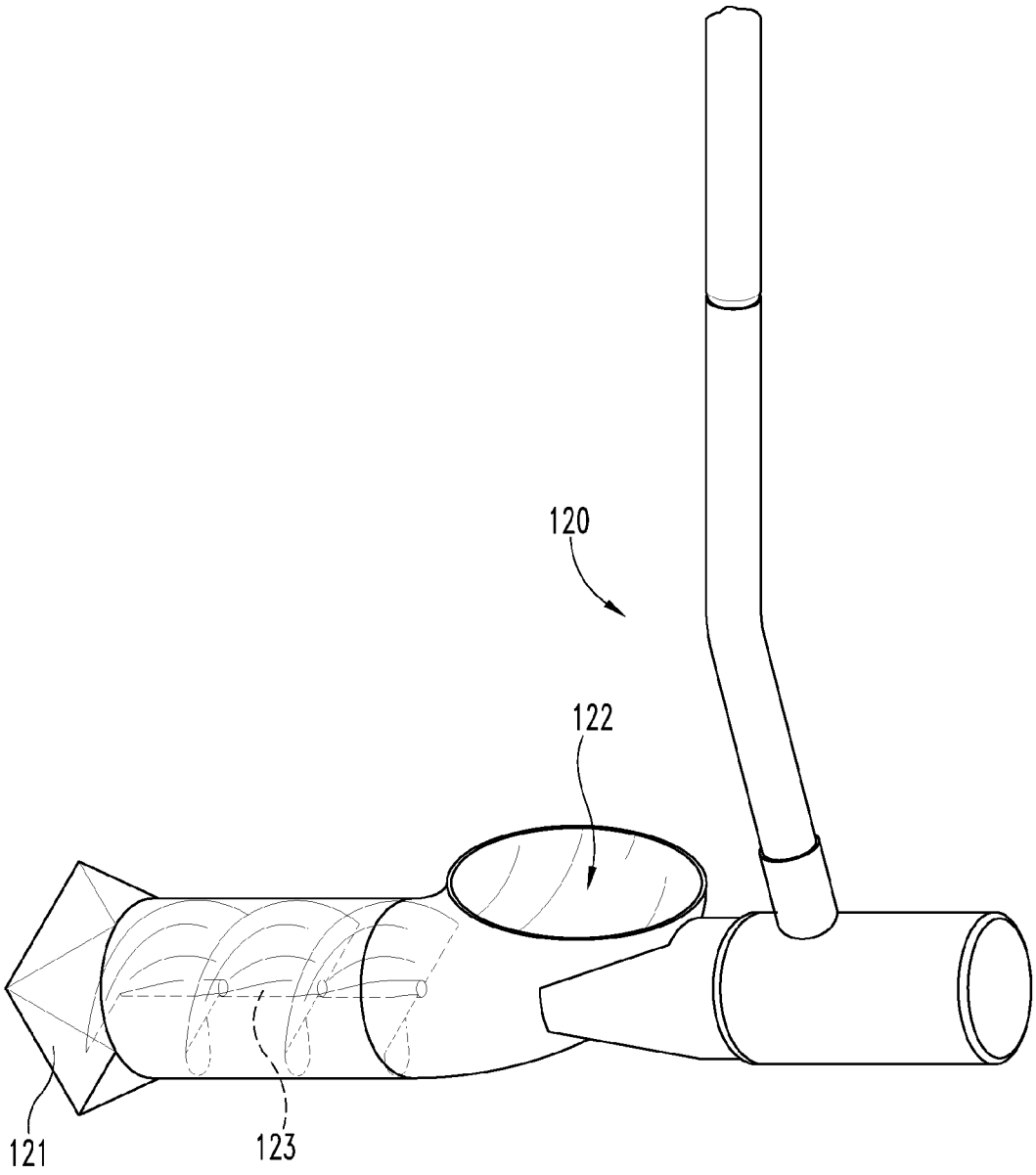
FIG. 14 is a partial, perspective view of an alternative embodiment of a portable snow removal device according to the present disclosure.

Referring to FIG. 14, another embodiment is illustrated. Snow removal device 120 is similar to other, earlier embodiments disclosed herein and can be selectively configured with the range of options and alternatives already described and/or illustrated. The point of FIG. 14 is to illustrate a different inlet configuration for gathering or intaking snow. Inlet 121 has a square shape in one plane with tapering or diverging sides so as to create a scoop or hopper configuration. The snow entering inlet 121 is conveyed to outlet 122 by mechanism 123. The shape of inlet 121 allows a larger intake area for the snow and thereby faster removal.

Referring now to FIG. 15, another option for the snow removal mechanism 22, in lieu of auger 34 or one of the other snow removal mechanisms described herein, is illustrated. The illustrated snow removal mechanism 146 is a removable, rotatable brush-like structure with a series of heavy nylon blades 150 and 151, in lieu of more "conventional" bristles. Mechanism 146 is arranged in two sections, 148 and 149, that are symmetrically arranged and spaced on opposite sides of gear box 36. Each section 148 and 149 includes radiating blades 150 and end-extending blades 151. The gear box input shaft 37 connects to section 23*a* or 23*b* in the manner that has been illustrated and described. Each blade section 148 and 149 includes a driveshaft 152 and 153, respectively. Each driveshaft is connected to gear box 36 at a right angle relative to input shaft 37.

While the preferred embodiment of the invention has been illustrated and described in the drawings and foregoing description, the same is to be considered as illustrative and not restrictive in character, it being understood that all changes and modifications that come within the spirit of the invention are desired to be protected.

The invention claimed is:

1. A snow removal device comprising:

a handle subassembly including a reversible motor and a shaft having a connection end;

a snow removal mechanism constructed and arranged for removing snow from a location;

a gear box having a drive input and a drive output, said drive input being connected to said connection end, and said drive output being connected to said snow removal mechanism, said gear box being positioned between said reversible motor and said snow removal mechanism;

and an extension member positioned between said gearbox and said snow removal mechanism, said extension member being constructed and arranged for a snap-fit connection with said snow removal mechanism wherein said extension member provides a snap-fit interface for replacement of one style of snow removal mechanism with another style of snow removal mechanism.

2. The snow removal device of claim 1 wherein said motor is a variable speed motor.

3. The snow removal device of claim 2 wherein said handle subassembly includes a removable, rechargeable battery.

4. The snow removal device of claim 1 wherein said snow removal mechanism includes an auger.

5. The snow removal device of claim 1 wherein said snow removal mechanism includes a paddlewheel.

6. The snow removal device of claim 5 wherein said paddlewheel includes a plurality of curved blades.

7. The snow removal device of claim 1 wherein said snow removal mechanism includes a brush with radiating bristles.

8. The snow removal device of claim 1 wherein said shaft includes two shaft sections that are joined together.

9. The snow removal device of claim 1 wherein said snow removal device includes an auger, said auger being connected to said gear box.

* * * * *